United States Patent [19]

Shew

[11] Patent Number: 4,539,630

[45] Date of Patent: Sep. 3, 1985

[54] BRIGHTNESS AND COLOR REGULATABLE LAMPSHADE

[76] Inventor: Shan W. Shew, P.O. Box 10780, Taipei, Taiwan, Taiwan

[21] Appl. No.: 466,539

[22] Filed: Feb. 15, 1983

[51] Int. Cl.[3] ..... F21P 3/00

[52] U.S. Cl. ..... 362/318; 362/101; 362/811

[58] Field of Search ..... 362/96, 101, 317, 318, 362/331, 811, 812; 350/267, 312; 40/431, 441, 480, 554; 116/264, 273

[56] References Cited

U.S. PATENT DOCUMENTS

| | | | |
|---|---|---|---|
| 829,337 | 8/1906 | Herr | 362/318 |
| 1,614,004 | 1/1927 | Larson | 362/318 |
| 2,448,318 | 8/1948 | Lowry | 362/318 X |
| 2,520,691 | 8/1950 | Otis | 362/318 X |
| 2,709,217 | 5/1955 | McCluskey | 362/101 |
| 2,860,232 | 11/1958 | Gray | 362/101 X |
| 3,056,019 | 9/1962 | Apatoff et al. | 362/318 X |
| 3,531,635 | 9/1970 | Hancock | 362/101 |
| 3,738,036 | 6/1973 | Landsinger et al. | 362/96 X |
| 3,914,027 | 10/1975 | Caron | 350/267 |
| 4,072,855 | 2/1978 | Marchese | 362/101 |
| 4,170,035 | 10/1979 | Walker | 362/96 X |
| 4,344,113 | 8/1982 | Ditto et al. | 362/318 X |

FOREIGN PATENT DOCUMENTS

| | | | |
|---|---|---|---|
| 2448685 | of 1979 | France | 362/318 |

*Primary Examiner*—Deborah L. Kyle
*Assistant Examiner*—John E. Griffiths

[57] ABSTRACT

A decorative lampshade comprising translucent sealed walls, in which a translucent body surrounded by a liquid is located. The height of the body and the distance between the body and walls can be adjusted by bolts extending outside the lampshade. Adjustment of the bolts regulates the brightness and color of the lampshade.

1 Claim, 4 Drawing Figures

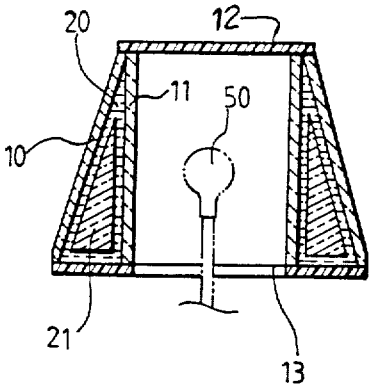
FIG - 1
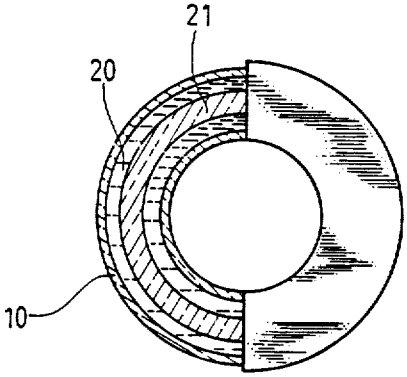
FIG - 2
FIG - 3
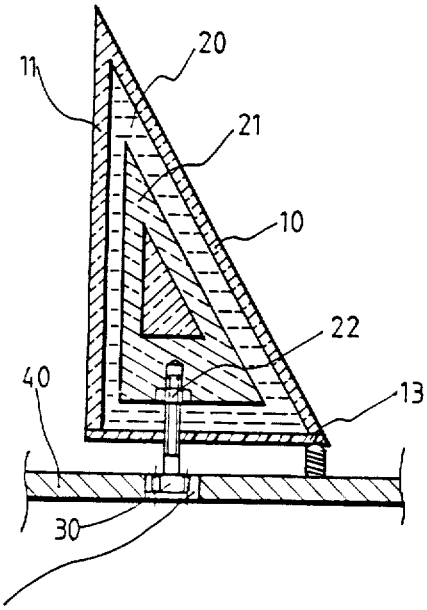
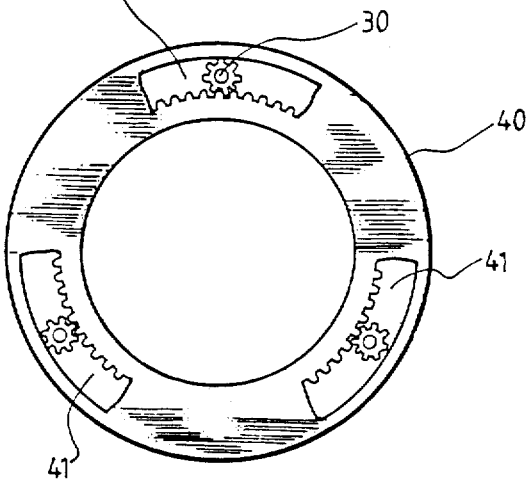
FIG - 4

BRIGHTNESS AND COLOR REGULATABLE LAMPSHADE

BRIEF SUMMARY OF THE INVENTION

This invention is a decorative lampshade, whose brightness and decorative effects can be regulated, and whose colors can be changed.

Traditional lampshades, no matter what their styles, cannot be changed after molding, unless decorative accessories are added.

This invention is a new design of lampshade with high-quality decoration.

BRIEF DESCRIPTION OF THE DRAWINGS:

FIG. 1 is a frontal cross-sectional view of the invention.

FIG. 2 is a view from underneath.

FIG. 3 is a view of the structure of the body, which can be regulated.

FIG. 4 is another view from below.

10—outer wall, 11—inner wall, 12—upper wall, 13—lower wall, 20—sealed space, 21—body, 22—nut, 30—regulating bolt, 40—under-frame, 41—indented annular hole, 50—lightbulb.

DETAILED DESCRIPTION

Referring to FIGS. 1 to 4, this invention is a translucent round-shaped lampshade, which is divided into outer wall 10 and inner wall 11. On top of outer wall 10 and inner wall 11 is upper wall 12; and under the bottom is lower wall 13, thus enabling a sealed spaced 20 which is formed by outer wall, inner wall, upper wall and lower wall. Before sealing space 20, a hole has been made on the upper wall for pouring liquid. And before sealing the above-mentioned lower wall, inner wall 11 and outer wall 10, a translucent body is placed in space 20. The exterior of body 21, and the interior of space 20 are similar. A regulating apparatus (see FIGS. 3–4) is allocated to regulate the movement of body 21. As shown in FIGS. 3–4, indented annular holes 41 can be allocated through toroidal underframe 40 at an angle of 120°. Regulating bolts 30 frictionally extend into the annular holes 41. The upper ends of regulating screws 30 enter closed space 20 and lock with nuts 22 of body 21. When underframe 40 revolves, the movement of body 21 can be accurately regulated.

When body 21 moves higher, it will be in closer contact with outer wall 10 and inner wall 11. In other words, there is less liquid in between body 21 and walls 10 and 11. Suppose body 21 is transparent, then no matter whether the liquid inside space 20 and walls 10 and 11 is transparent or colored the brightness and color of light bulb 50 will change in accordance with the movement of body 21.

I claim:

1. A decorative lampshade for use with and surrounding a light source comprising:

an annular translucent outer wall having an upper end and a lower end, an annular translucent inner wall having an upper end and a lower end, said upper end of said outer wall integrally sealed to said upper end of said inner wall, a toroidal lower wall having an inner edge and outer edge, said outer wall lower end sealed to said lower wall outer edge and said inner wall lower end sealed to said lower wall inner edge, an annular translucent body within said walls, a colored liquid within said walls surrounding said body, a regulating bolt having a higher end and a lower end, said higher end rotatably secured within said body, said bolt extending through said lower wall, an under-frame having an annular hole frictionally receiving one side of said bolt lower end, whereby rotation of said under-frame with respect to said walls rotates said bolt which adjusts the height of said body within said walls regulating the amount of liquid between the walls and the brightness and color of said light source.

* * * * *